US012415214B2

(12) United States Patent
Liu et al.

(10) Patent No.: US 12,415,214 B2
(45) Date of Patent: Sep. 16, 2025

(54) ROLLING MECHANISM, SKEW ROLLING MILL AND METHOD FOR ROLLING ULTRAFINE-GRAINED M50NIL ROD

(71) Applicant: Anhui DongYun Intelligent Rolling Equipment Co., Ltd., Suzhou (CN)

(72) Inventors: Dong Liu, Suzhou (CN); Zhe Zhang, Suzhou (CN); Jianguo Wang, Suzhou (CN)

(73) Assignee: ANHUI DONGYUN INTELLIGENT ROLLING EQUIPMENT CO., LTD., Suzhou (CN)

( * ) Notice: Subject to any disclaimer, the term of this patent is extended or adjusted under 35 U.S.C. 154(b) by 258 days.

(21) Appl. No.: 18/300,355

(22) Filed: Apr. 13, 2023

(65) Prior Publication Data

US 2024/0189880 A1 Jun. 13, 2024

(30) Foreign Application Priority Data

Dec. 7, 2022 (CN) ..... 202211563143.4

(51) Int. Cl.
*B21B 1/20* (2006.01)
*B21B 19/12* (2006.01)

(52) U.S. Cl.
CPC ..... *B21B 1/20* (2013.01); *B21B 19/12* (2013.01)

(58) Field of Classification Search
CPC ..... B21B 1/20; B21B 1/16; B21B 13/008; B21B 19/12; B21B 19/16; B21B 19/02; B21B 19/04; B21B 19/06
See application file for complete search history.

(56) References Cited

U.S. PATENT DOCUMENTS 1,957,916 A * 5/1934 Stiefel ..... B21B 19/02 72/97

* cited by examiner

*Primary Examiner* — Debra M Sullivan
(74) *Attorney, Agent, or Firm* — MATTHIAS SCHOLL P.C.; Matthias Scholl

(57) ABSTRACT

The disclosure provides a rolling mechanism for grain refinement of an M50NiL rod. The rolling mechanism includes two main rolls and two auxiliary rolls. The two main rolls are opposite to each other and the two auxiliary rolls are opposite to each other, and the two main rolls and the two auxiliary rolls are disposed around a rolling line to form a nip zone. In any cross section of the nip zone with the rolling line as a normal line, a first line connecting the central axes of the two main rolls is perpendicular to a second line connecting the central axes of the two auxiliary rolls; each main roll further includes a first protrusion portion, a first end portion and a second end portion. The first end portion and the second end portion are disposed opposite each other along a corresponding roll axis.

11 Claims, 6 Drawing Sheets

ROLLING MECHANISM, SKEW ROLLING MILL AND METHOD FOR ROLLING ULTRAFINE-GRAINED M50NIL ROD

CROSS-REFERENCE TO RELATED APPLICATIONS

Pursuant to 35 U.S.C. § 119 and the Paris Convention Treaty, this application claims foreign priority to Chinese Patent Application No. 202211563143.4 filed Dec. 7, 2022, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to the field of metal rolling, and more particularly, to a rolling mechanism, a skew rolling mill, and a method for rolling an ultra-fine-grained M50NiL rod.

Methods such as grain-boundary strengthening, solid solution strengthening, dispersion strengthening and second phase strengthening are often used to increase the mechanical properties of metal materials and enhance the tensile strength or toughness of a rod. In the grain-boundary strengthening technique, the finer the grain size, the more the grain boundaries, which will block the dislocation of the grains. Thus, the strength of the metal material is increased, preventing the formation of cracks in the rod. Conventional technologies are ineffective in refining the grain structure of a metal rod, particularly in a soft aluminum rod. The resulting rods are only a few tens of millimeters in diameter, and cannot meet the demand for large sizes. In the related arts, a rolling mill tends to get stuck when the metal billet does not move forward during a rolling process, regardless of whether or not it rotates; as a result, the metal billet is built into an undesirable shape, affecting the grain refinement and causing significant wear and tear on a mold.

SUMMARY

The first objective of the disclosure is to provide a rolling mechanism for grain refinement of an M50NiL rod.

The rolling mechanism comprises two main rolls and two auxiliary rolls; the two main rolls are opposite to each other and the two auxiliary rolls are opposite to each other, and the two main rolls and the two auxiliary rolls are disposed around a rolling line to form a nip zone where a billet is rolled into a rod;

in any cross section of the nip zone with the rolling line as a normal line, a first line connecting the central axes of the two main rolls is perpendicular to a second line connecting the central axes of the two auxiliary rolls;

each main roll further comprises a first protrusion portion, a first end portion and a second end portion; the first end portion and the second end portion are disposed opposite each other along a corresponding roll axis; the first end portion has a smaller diameter than the second end portion; the first protrusion portion is disposed between the first end portion and the second end portion;

each auxiliary roll further comprises a second protrusion portion, a third end portion and a fourth end portion; the third end portion and the fourth end portion are disposed opposite each other along a corresponding roll axis; the third end portion has a smaller diameter than the fourth end portion; the second protrusion portion is disposed between the first third end portion and the second fourth end portion; and the first protrusion portion has a greater diameter than the second protrusion portion; a narrow space is formed by the two first protrusion portions and the two protrusion portions; the first end portion is disposed corresponding to the fourth end portion; and the second end portion is disposed corresponding to the third end portion.

In a class of this embodiment, a ratio of a length of the first line to a length of the second line is a constant ranging from 1-1.1; and/or the two main rolls and the two auxiliary rolls have the same length; the first protrusion portion is disposed on a midpoint of a first axis from the first end portion to the second end portion; and the second protrusion portion is disposed on a midpoint of a second axis from the third end portion to the fourth end portion.

In a class of this embodiment, the two main rolls and the two auxiliary rolls separately comprise at least three truncated cones arranged along a corresponding roll axis; each truncated cone comprises a top surface and a base surface; every two adjacent truncated cones are connected by attaching the top surface to an adjacent base surface; the top surface has the same diameter as the adjacent base surface; and at least two truncated cones are disposed between the first protrusion portion and the second end portion, and between the second protrusion portion and the fourth end portion.

In a class of this embodiment, the two main rolls have the same shape as the two auxiliary rolls;

the two main rolls and the two auxiliary rolls separately comprise four truncated cones arranged along a corresponding roll axis; three truncated cones are disposed between the first protrusion portion and the second end portion, and between the second protrusion portion and the fourth end portion.

In a class of this embodiment, each truncated cone has a roll surface angle ranging from 2.5° to 5°.

In a class of this embodiment, each main roll comprises a first truncated cone and a second truncated cone arranged from the first end portion to the second end portion; the first protrusion portion is formed between the first truncated cone and the second truncated cone;

each auxiliary roll comprises a third truncated cone and a fourth truncated cone arranged from the third end portion to the fourth end portion; the second protrusion portion is formed between the third truncated cone and the fourth truncated cone.

In a class of this embodiment, a ratio of the length of each main roll to a diameter of the first protrusion portion ranges from 3 to 7; and/or a ratio of the diameter of the first protrusion portion to a diameter of the second protrusion portion ranges from 1 to 2.

The second objective of the disclosure is to provide a skew rolling mill; the skew rolling mill comprises a first power mechanism, a second power mechanism and the rolling mechanism; the first power mechanism and the second power mechanism are configured to rotate the two main rolls and the two auxiliary rolls, respectively.

In a class of this embodiment, a distance between the two main rolls is adjustable; and/or a distance between the two auxiliary rolls is adjustable.

The third objective of the disclosure is to provide a method for rolling an ultra-fine-grained M50NiL rod, and the method comprises:

S1. preparing a M50NiL rod with a diameter ranging from 220 mm to 350 mm as the billet;

S2. heating the billet within a preset time at a preset temperature;

S3. feeding the billet into the skew rolling mill to obtain a semi-finished product; and S4. cooling the semi-finished product to obtain an ultra-fine-grained M50NiL rod;

an entry angle ranges from 10° to 13°; and a nip angle ranges from 7° to 10°.

In a class of this embodiment, S3 further comprises:

S3-1. feeding the heated billet through a feed inlet adjacent to the two second end portions into the nip zone for rolling, and forcing the semi-finished product to move through a feed outlet adjacent to two fourth end portions.

In a class of this embodiment, the two main rolls have the same shape as the two auxiliary rolls; the two main rolls and the two auxiliary rolls separately comprise at least three truncated cones arranged along a corresponding roll axis; at least two truncated cones are disposed between the first protrusion portion and the second end portion, and between the second protrusion portion and the fourth end portion;

each truncated cone comprises a top surface and a base surface; every two adjacent truncated cones are connected by attaching the top surface to an adjacent base surface; the top surface has the same diameter as the adjacent base surface; for each main roll, the first truncated cone and the second truncated cone are arranged from the first end portion to the second end portion; the first protrusion portion is formed between the first truncated cone and the second truncated cone; for each auxiliary roll, the third truncated cone and the fourth truncated cone arranged from the third end portion to the fourth end portion; the second protrusion portion is formed between the third truncated cone and the fourth truncated cone; distances between the two main rolls and between the two auxiliary rolls are adjustable; S3 further comprises:

S3-2. adjusting the distances between the two main rolls and between the two auxiliary rolls; either feeding the heated billet through the feed inlet adjacent to the two second end portions into the nip zone for rolling and forcing the semi-finished product to move through the feed outlet adjacent to two fourth end portions, or feeding the heated billet through a feed inlet adjacent to the two fourth end portions into the nip zone for rolling and forcing the semi-finished product to move through the feed outlet adjacent to the second end portions; and S3-3. repeating S3-2.

In a class of this embodiment, the two main rolls and the two auxiliary rolls rotate at a speed ranging from 11 r/min to 13 r/min.

In a class of this embodiment, a ratio of the diameter of the first protrusion portion to the diameter of the billet ranges from 1 to 5.

In the disclosure, the two main rolls and the auxiliary rolls are arranged at circumferential intervals of 90° around the rolling line, to keep the rolling mechanism from getting stuck and enhance deformation capacity of the billet, thereby achieving grain refinement; additionally, the two main rolls are partially in contact with the two auxiliary rolls, so a large-sized metal rod is produced with a relatively low load. The first end portions are disposed corresponding to the fourth end portions, and the second end portions are disposed corresponding to the third end portions, so that the two main rolls and the two auxiliary rolls are arranged tightly to prepare a smaller diameter rod; additionally, the two main rolls and the two auxiliary rolls have different linear velocities which increase a force acting upon the M50NiL rod in a circular direction, thus improving the grain refinement.

Figure 1:
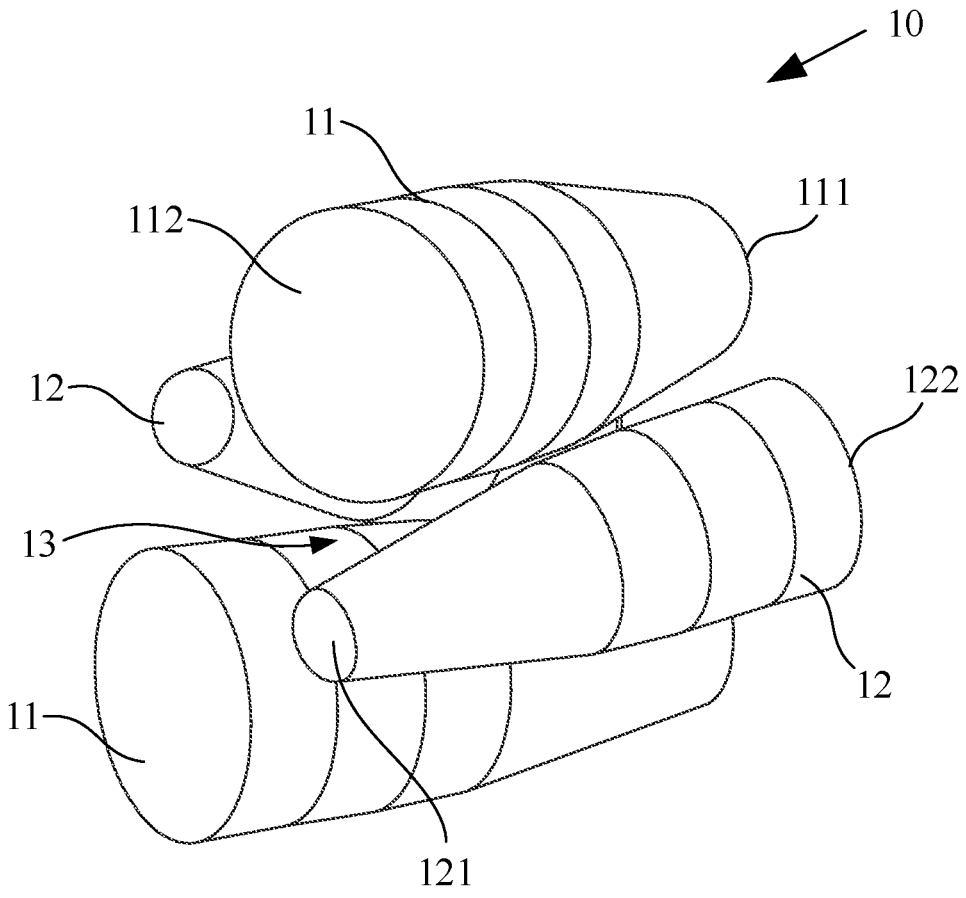
FIG. 1 is a perspective view of a rolling mechanism according to Example 1 of the disclosure.

In the drawings, the following reference numbers are used: 100. Skew rolling mill; 10. Rolling mechanism; 11. Main roll; 111. First end portion; 112. Second end portion; 113. First protrusion portion; 114. First main truncated cone; 115. Second main truncated cone; 116. Third main truncated cone; 117. Fourth main truncated cone; 12. Auxiliary roll; 121. Third end portion; 122. Fourth end portion; 123. Second protrusion portion; 124. First auxiliary truncated cone; 125. Second auxiliary truncated cone; 126. Third auxiliary truncated cone; 127. Fourth auxiliary truncated cone; 13. Nip zone; 20. First power mechanism; 30 Second power mechanism; and 200. Billet.

DETAILED DESCRIPTION

The term "getting stuck" as used herein refers to phenomenon where a billet does not move forward during a rolling process, regardless of it rotates or not;

The term "nip zone" as used herein refers to a region formed by rolls, in which the billet is rolled into a rod; the nip zone is formed by two main rolls and two auxiliary rolls;

The term "rolling line" as used herein refers to a track of the center point of the billet moving forward during the rolling process, that is, a centerline of the two main rolls and two auxiliary rolls;

The term "ellipticity" as used herein refers to a ratio of a distance between the two auxiliary rolls to a distance between the two main rolls on a cross section with the rolling line as the normal in the nip zone;

The term "narrow space" as used herein refers to the position where the cross sectional area of the nip zone is smallest.

The term "entry angle" as used herein refers to an included angle between the rolling line and a projection of a roll axis onto a horizontal cross-section passing through the rolling line; the two main rolls are disposed in a straight line, and the two auxiliary rolls are disposed horizontally with each other.

The term "nip angle" as used herein refers to an included angle between the rolling line and a projection of a rolling axis onto a vertical cross-section passing through the rolling line; the two main rolls are disposed vertically; and the two auxiliary rolls are disposed horizontally.

The term "roll surface angle" as used herein refers to an included angle between the rolling line and the generatrix of a truncated cone; the generatrix is located on a cross-section passing through the rolling axis.

The term "roll diameter" as used herein refers to a diameter of a cross section of a roll.

The term "diameter reduction" as used herein refers to a rolling process by which the diameter of the billet is reduced.

The term "roundness adjustment" as used herein refers to a process in which the billet is passed through the narrow space to achieve a higher roundness.

Example 1

Figure 2:
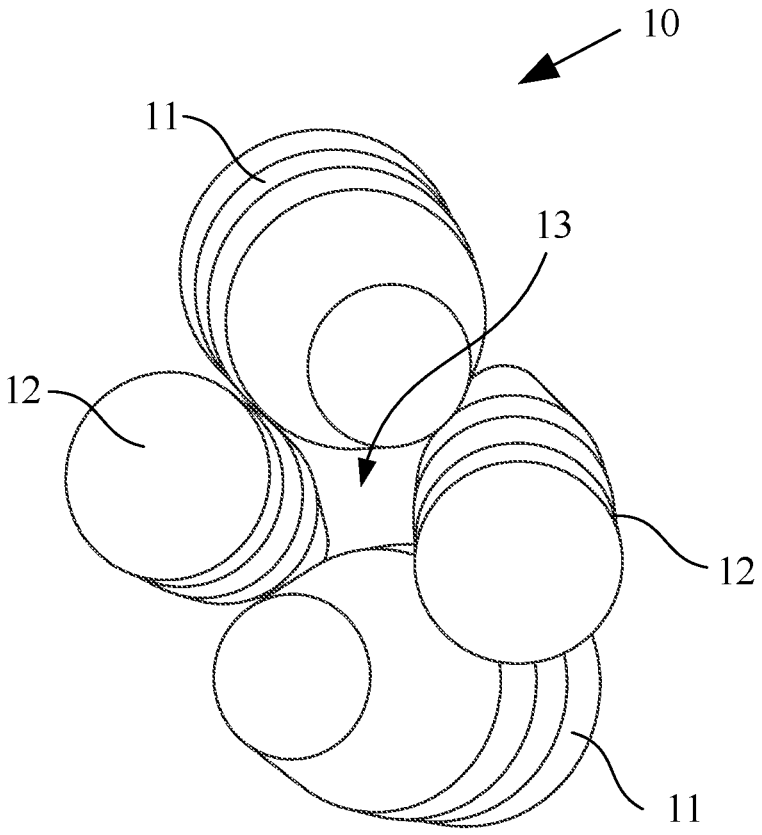
FIG. 2 is another perspective view of a rolling mechanism according to Example 1 of the disclosure.
Figure 3:
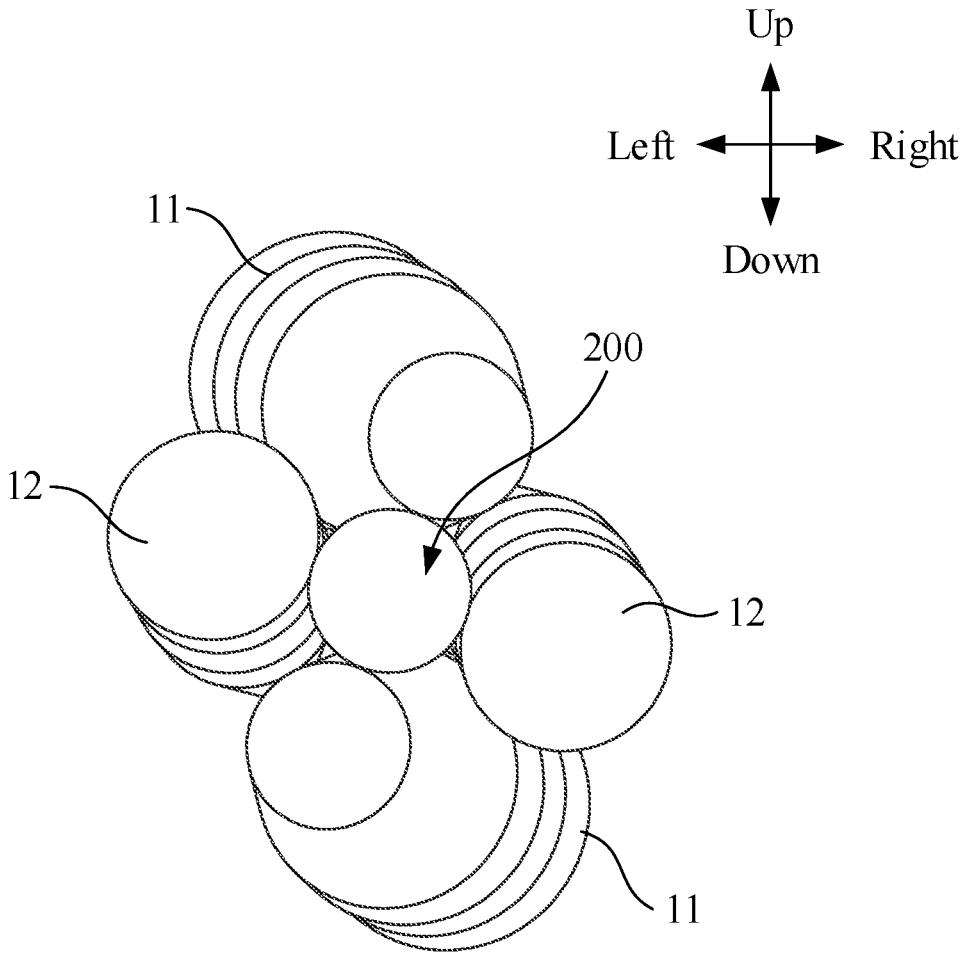
FIG. 3 is a perspective view of a nip zone for receiving a billet according to Example 1 of the disclosure.

Referring to FIGS. 1-3, a rolling mechanism 10 comprises two main rolls 11 and two auxiliary rolls 12; the two main rolls 11 and the two auxiliary rolls 12 are separately disposed opposite each other around a rolling line to form a nip zone 13 where a billet is rolled into a rod; in any cross section of the nip zone 13 with the rolling line as a normal line, a first line connecting the central axes of the two main rolls is perpendicular to a second line connecting the central axes of the two auxiliary rolls; in other words, the two main rolls and the two auxiliary rolls are arranged at circumferential intervals of 90° around the rolling line, so that the billet 200 is evenly rolled by the two main rolls 11 and the two auxiliary rolls 12. In the example, the two main rolls 11 are disposed vertically and the two auxiliary rolls 12 are disposed horizontally. Alternatively, the two main rolls 11 are disposed horizontally, and the two auxiliary rolls 12 are disposed vertically.

Figure 4:
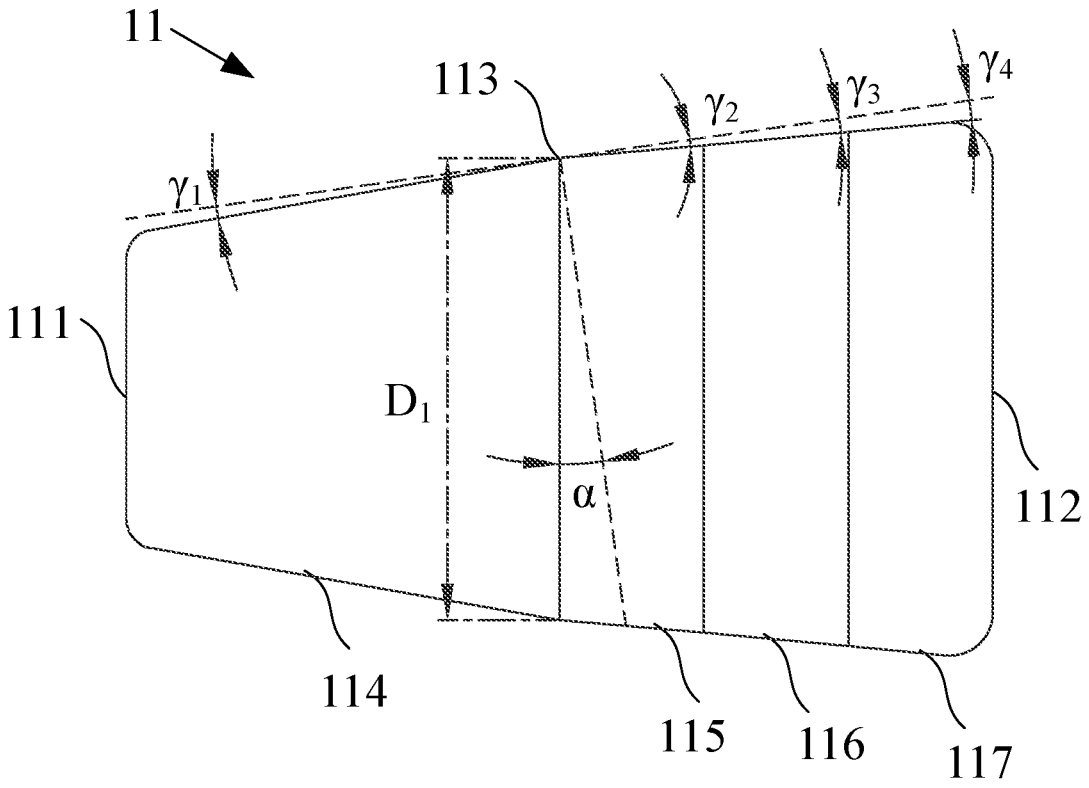
FIG. 4 is a right view of a main roll according to Example 1 of the disclosure.
Figure 5:
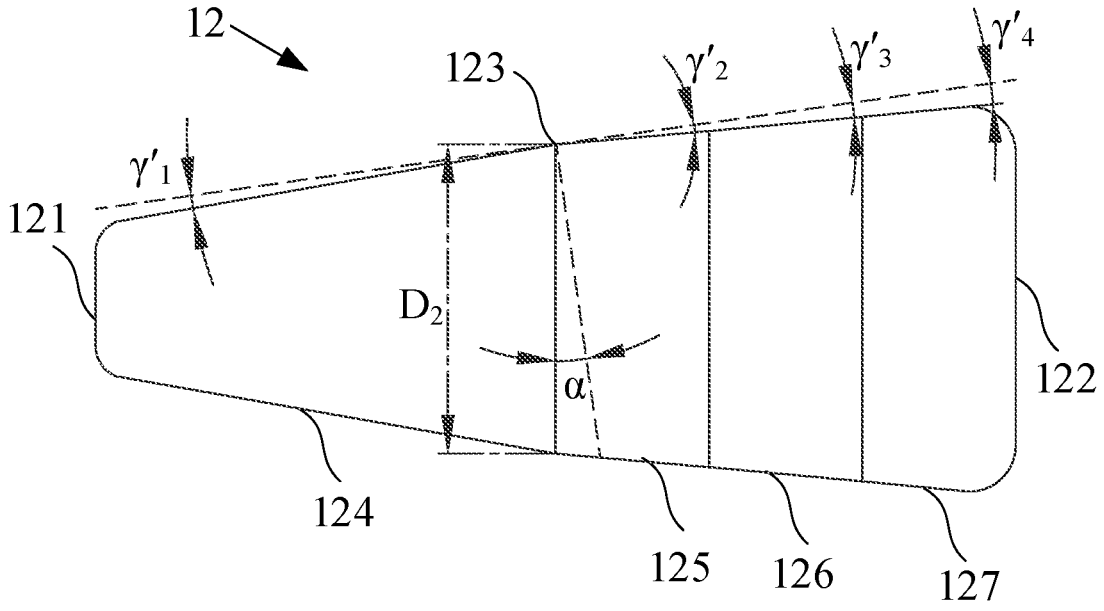
FIG. 5 is a right view of an auxiliary roll according to Example 1 of the disclosure.

In an alternative preferred embodiment, referring to FIGS. 1, 4 and 5, each main roll further comprises a first protrusion portion 113, a first end portion 111 and a second end portion; the first end portion 111 and the second end portion 112 are disposed opposite each other along a corresponding roll axis; the first end portion 111 has a smaller diameter than the second end portion; the first protrusion portion is disposed between the first end portion 111 and the second end portion; each auxiliary roll further comprises a second protrusion portion 123, a third end portion 121 and a fourth end portion 122; the third end portion and the fourth end portion are disposed opposite each other along a corresponding roll axis; the third end portion has a smaller diameter than the fourth end portion; the second protrusion portion is disposed between the third end portion and the fourth end portion; the diameter $D_1$ of the first protrusion portion 113 is greater than the diameter $D_2$ of the second protrusion portion 123; and a narrow space is formed by the two first protrusion portions 113 and the two second protrusion portions 123.

In related arts, the rolling mechanism generally comprises two rolls and two guide plates; as the billet 200 passes through a diameter reduction section of the nip zone 13, excess metal materials move to the two guide plates; a friction occurs between the billet and the two guide plates and causes the billet to slow down; the fluidity of the billet decreases because the two guide plates dissipate heat rapidly; as a result, the rolling mechanism becomes stuck. In the disclosure, the two main rolls and the auxiliary rolls are arranged at circumferential intervals of 90° around the rolling line, to keep the rolling mechanism from getting stuck and enhance deformation capacity of the billet 200, thereby achieving grain refinement; additionally, the two main rolls 11 is partially in contact with the two auxiliary rolls, so a large-sized metal rod is produced with a relatively low load.

In an alternative preferred embodiment, the first end portions are disposed corresponding to the fourth end portions, and the second end portions are disposed corresponding to the third end portions, so that the two main rolls and the two auxiliary rolls are arranged tightly to prepare a smaller diameter rod; additionally, the two main rolls and the two auxiliary rolls have different linear velocities which increase a force acting upon the M50NiL rod in a circular direction, thus improving the grain refinement.

In an alternative preferred embodiment, a ratio of a length of the first line to a length of the second line remains unchanged. In other words, the ellipticity of the nip zone 13 remains unchanged. As a fixed volume of the billet 200 passes through the nip zone 13, the cross section of the billet is gradually reduced before reaching the narrow space. Specifically, as the billet moves through the slip zone and the diameter reduction section, excess metal materials flow along the roll axis and move into the gaps between the rolls, which causes deformation of the metal rod, resulting in a jammed rolling mechanism. The ellipticity of the nip zone 13 remains unchanged, allowing the metal materials to move circumferentially; when the four rolls are driver rolls, the amount of the metal materials flowing along the roll axis is increased, keeping the rolling mechanism from getting stuck; the metal materials are then passed through the narrow space and the roundness adjustment zone to ensure the form accuracy.

In an alternative preferred embodiment, the ratio of a length of the first line to a length of the second line ranges from 1 to 1.1; in other words, the ellipticity of the nip zone ranges from 1 to 1.1, such as 1, 1.05, 1.08, or 1.1.

In an alternative preferred embodiment, the two main rolls and the two auxiliary rolls separately comprise at least three truncated cones arranged along a corresponding roll axis; each truncated cone comprises a top surface and a base surface; every two adjacent truncated cones are connected by attaching the top surface to an adjacent base surface; the top surface has the same diameter as the adjacent base surface; at least two truncated cones are disposed between the first protrusion portion and the second end portion, and between the second protrusion portion and the fourth end portion; the at least two truncated cones function as the roundness adjustment zone and has a greater length than only one truncated cone, achieving an improved roundness of a rod. In actual use, the bottoms of any two adjacent truncated cones of the two main rolls 11 are coplanar, and the bottoms of any two adjacent truncated cones of the two auxiliary rolls 12 are coplanar.

In an alternative preferred embodiment, the two main rolls 11 have the same shape as the two auxiliary rolls 12; the two main rolls and the two auxiliary rolls separately comprise four truncated cones arranged along a corresponding roll axis; three truncated cones are disposed between the first protrusion portion and the second end portion, and between the second protrusion portion and the fourth end portion. In an alternative preferred embodiment, the two main rolls 11 are different in shape from the two auxiliary rolls. In an alternative preferred embodiment, two, four, or five truncated cones are disposed between the first protrusion portion 113 and the second end portion 112, and between the second protrusion portion 123 and the fourth end portion 122. For each main roll 11, the five truncated cones arranged from the first end portion 111 to the second end portion 112 are defined as a first main truncated cone 114, a second main truncated cone 115, a third main truncated cone 116, and a fourth main truncated cone 117, respectively; for each auxiliary roll 12, the five truncated cones arranged from the third end portion 121 to the fourth end portion 122 are defined as a first auxiliary truncated cone 124, a second auxiliary truncated cone 125, a third auxiliary truncated cone 126, and a fourth auxiliary truncated cone 127, respectively.

In an alternative preferred embodiment, for the two main rolls 11 and the two auxiliary rolls 12, each truncated cone has a roll surface angle ranging from 2.5° to 5°; specifically, the first main truncated cone 114, the second main truncated cone 115, the third main truncated cone 116, the fourth main truncated cone 117, the first auxiliary truncated cone 124, the second auxiliary truncated cone 125, the third auxiliary truncated cone 126, and the fourth auxiliary truncated cone 127 respectively have roll surface angles $\gamma_1$, $\gamma_2$, $\gamma_3$, $\gamma_4$, $\gamma'_1$, $\gamma'_2$, $\gamma'_3$, and $\gamma'_4$ ranging from 2.5° to 5°; for example, the roll surface angles $\gamma_1$, $\gamma_2$, $\gamma_3$, $\gamma_4$, $\gamma'_1$, $\gamma'_2$, $\gamma'_3$, and $\gamma'_4$ may be 2.5°, 3°, 4°, or 5°.

In an alternative preferred embodiment, for each main roll 11, at least two of the truncated cones have the same roll surface angle; specifically, at least two of the roll surface angles $\gamma_1$, $\gamma_2$, $\gamma_3$, $\gamma_4$ are equal. In an alternative preferred embodiment, for each main roll, the roll surface angles are not equal; specifically, the roll surface angles $\gamma_1$, $\gamma_2$, $\gamma_3$, $\gamma_4$ are not equal.

In an alternative preferred embodiment, for each auxiliary roll 12, at least two of the truncated cones have the same roll surface angle; specifically, at least two of the roll surface angles $\gamma'_1$, $\gamma'_2$, $\gamma'_3$, and $\gamma'_4$ are equal. In an alternative preferred embodiment, for each main roll, the roll surface angles are not equal; specifically, the roll surface angles $\gamma'_1$, $\gamma'_2$, $\gamma'_3$, and $\gamma'_4$ are not equal.

In an alternative preferred embodiment, for each main roll, the first main truncated cone and the second main truncated cone are arranged from the first end portion to the second end portion; the first protrusion portion 113 is formed between the first main truncated cone 114 and the second main truncated cone.

In an alternative preferred embodiment, for each auxiliary roll, the first auxiliary truncated cone and the second auxiliary truncated cone are arranged from the third end portion to the fourth end portion; the second protrusion portion 123 is formed between the first auxiliary truncated cone 124 and the second auxiliary truncated cone.

In an alternative preferred embodiment, the two main rolls and the two auxiliary rolls have the same length; understandably, in certain examples, the two main rolls and the two auxiliary rolls have different lengths.

In an alternative preferred embodiment, the first protrusion portion is disposed on a midpoint of a first axis from the first end portion to the second end portion; the second protrusion portion is disposed on a midpoint of a second axis from the third end portion to the fourth end portion. Therefore, the narrow space is formed in the middle of the nip zone 13 to receive the billet 200; after passing through the narrow space, the billet 200 is rolled into a smaller diameter rod with a circular cross section. In the example, the first protrusion portion 113 is formed between the first main truncated cone 114 and the second main truncated cone 115; a length of the first main truncated cone 114 is equal to a total length of the second main truncated cone 115, the third main truncated cone 116, and the fourth main truncated cone 117; the second protrusion portion 123 is formed between the first auxiliary truncated cone 124 and the second auxiliary truncated cone 125; a length of the first auxiliary truncated cone 124 is equal to a total length of the second auxiliary truncated cone 125, the third auxiliary truncated cone 126, and the fourth auxiliary truncated cone 127.

In an alternative preferred embodiment, the truncated cones between the first protrusion portion 113 and the second end portion 112 have the same length; specifically, the second main truncated cone 115, the third main truncated cone 116, and the fourth main truncated cone 117 have the same length. In an alternative preferred embodiment, at least two of the truncated cones between the first protrusion portion 113 and the second end portion 112 have different lengths; specifically, at least two of the second main truncated cone 115, the third main truncated cone 116, and the fourth main truncated cone 117 have different lengths.

In an alternative preferred embodiment, the truncated cones between the second protrusion portion 123 and the fourth end portion 122 have the same length; specifically, the second auxiliary truncated cone 125, the third auxiliary truncated cone 126, and the fourth auxiliary truncated cone 127 have the same length. In an alternative preferred embodiment, at least two of the truncated cones between the second protrusion portion 123 and the fourth end portion 122 have different lengths; specifically, at least two of the second auxiliary truncated cone 125, the third auxiliary truncated cone 126, and the fourth auxiliary truncated cone 127 have different lengths.

In an alternative preferred embodiment, a ratio of the length of each main roll to a diameter of the first protrusion portion ranges from 3 to 7, preferably 3, 4, 5, 6 or 7.

In an alternative preferred embodiment, a ratio of the diameter of the first protrusion portion to a diameter of the second protrusion portion ranges from 1 to 2, preferably 1, 1.3, 1.5, 1.8 or 2.0.

Example 2

Figure 6:
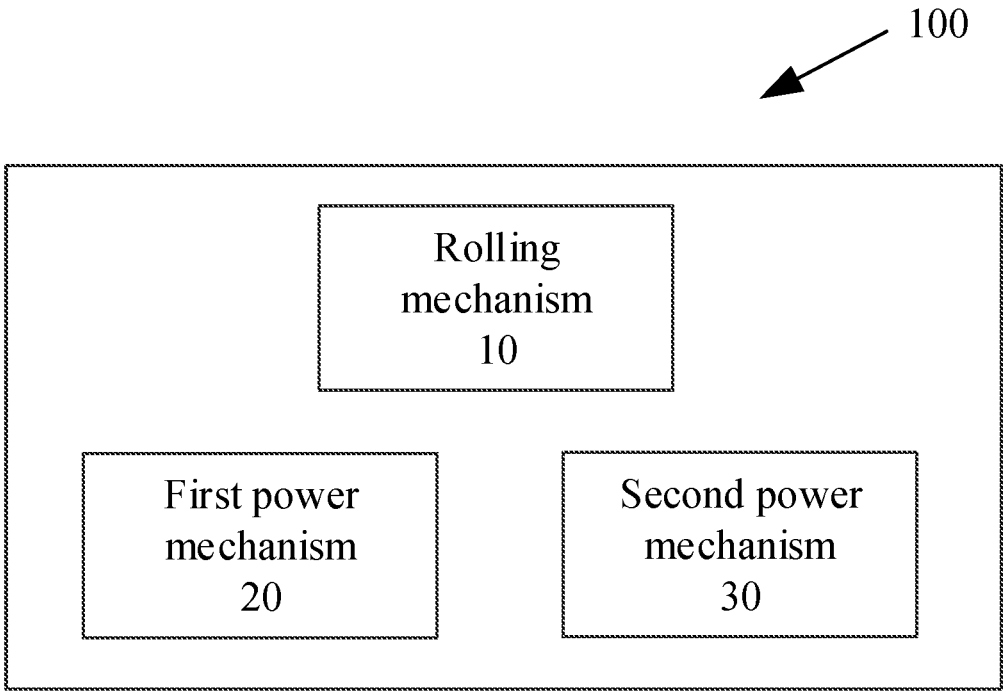
FIG. 6 is a block diagram of a skew rolling mill according to Example 1 of the disclosure.

Referring to FIGS. 1 and 6, a skew rolling mill 100 comprises a first power mechanism 20, a second power mechanism 30 and the rolling mechanism 10; the first power mechanism 20 and the second power mechanism 30 are configured to rotate the two main rolls 11 and the two auxiliary rolls 12, respectively, so that the billet 200 is deformed circumferentially, thereby improving the grain refinement.

In an alternative preferred embodiment, distances between the two main rolls and between the two auxiliary rolls are adjustable, so that the size of the nip zone is adjusted for repeatedly rolling the billet 200.

Example 3

A method for rolling an ultra-fine-grained M50NiL rod, and the method comprises:

S1. preparing an M50NiL rod with a diameter ranging from 220 mm to 350 mm as the billet;

S2. heating the billet within a preset time at a preset temperature;

S3. feeding the billet into the skew rolling mill to obtain a semi-finished product; and S4. cooling the semi-finished product to obtain an ultra-fine-grained M50NiL rod;

an entry angle ranges from 10° to 13°; and a nip angle ranges from 7° to 10°; the two main rolls and the two auxiliary rolls rotate at a speed ranging from 11 r/min to 13 r/min.

The skew rolling mill 100 is used to reduce the diameter of the billet 200 by 60%-80%, so that the billet 200 deform plastically to form an ultra-fine grain M50NiL rod having higher tensile strength and toughness.

M50NiL is a second-generation material for bearing steel. Conventional materials are unsuitable for use in the aviation industry's harsh conditions (such as heavy load, high temperature, and high speed) and must be modified for improved mechanical properties. M50NiL contains a large amount of Ni, but it has low strength and contact fatigue resistance, making it unsuitable for bearing performance under harsh conditions. By using the above method, the M50NiL rod with a diameter of 220 mm to 350 mm is rolled into an ultrafine-grained M50NiL rod with a diameter of 100 mm to 200 mm while improving the tensile strength and toughness of the M50NiL rod. In use, an M50NiL rod with a length of 300 mm to 15000 mm is selected as the billet 200.

In an alternative preferred embodiment, S3 further comprises S3-1: feeding the heated billet through a feed inlet adjacent to the two second end portions into the nip zone for rolling, and forcing the semi-finished product to move through a feed outlet adjacent to two fourth end portions. The two main rolls have higher linear velocities than the two auxiliary rolls, resulting in a larger contact area between the two main rolls and the billet is increased, thus making it easier for the skew rolling mill to receive the billet 200.

In an alternative preferred embodiment, S3 further comprises S3-2: adjusting the distances between the two main rolls and between the two auxiliary rolls; either feeding the heated billet through the feed inlet adjacent to the two second end portions into the nip zone for rolling and forcing the semi-finished product to move through the feed outlet adjacent to two fourth end portions, or feeding the heated billet through a feed inlet adjacent to the two fourth end portions into the nip zone for rolling and forcing the semi-finished product to move through the feed outlet adjacent to the second end portions; S3-3: repeating S3-2. In this example, the billet 200 can be rolled only once or multiple times. During a second or subsequent rolling processes, the billet 200 is fed into the nip zone 13 via the feed inlet or the feed outlet.

In an alternative preferred embodiment, a ratio of the diameter of the first protrusion portion 113 to the diameter of the billet 200 ranges from 1 to 5, preferably 1, 2, 3, 4 or 5.

In an alternative preferred embodiment, in S2, the preset temperature ranges from 980° C.-1080° C.; the preset time T is calculated using the following formula: T=Db*1 min, where Db is the diameter of the billet 200.

In an alternative preferred embodiment, in S4, the term "cooling" refers to cooling the semi-finished product to room temperature.

It will be obvious to those skilled in the art that changes and modifications may be made, and therefore, the aim in the appended claims is to cover all such changes and modifications.

What is claimed is:

1. A rolling mechanism for grain refinement of a metal rod, comprising two main rolls and two auxiliary rolls; wherein:

the two main rolls are opposite to each other and the two auxiliary rolls are opposite to each other, and the two main rolls and the two auxiliary rolls are disposed around a rolling line to form a nip zone where a billet is rolled into the metal rod;

in any cross section of the nip zone with the rolling line as a normal line, a first line connecting central axes of the two main rolls is perpendicular to a second line connecting central axes of the two auxiliary rolls;

each main roll comprises a first protrusion portion, a first end portion and a second end portion; the first end portion and the second end portion are disposed opposite each other along a corresponding roll axis; the first end portion has a smaller diameter than the second end portion; the first protrusion portion is disposed between the first end portion and the second end portion;

each auxiliary roll comprises a second protrusion portion, a third end portion and a fourth end portion; the third end portion and the fourth end portion are disposed opposite each other along a corresponding roll axis; the third end portion has a smaller diameter than the fourth end portion; the second protrusion portion is disposed between the third end portion and the fourth end portion; and the first protrusion portion has a greater diameter than the second protrusion portion; a narrow space of the nip zone is surrounded by the two first protrusion portions of the two main rolls and the two second protrusion portions of the two auxiliary rolls; the first end portion is disposed adjacent to the fourth end portion; and the second end portion is disposed adjacent to the third end portion.

2. The rolling mechanism of claim 1, wherein a ratio of a length of the first line to a length of the second line is a constant ranging from 1-1.1; and/or the two main rolls and the two auxiliary rolls have the same length; the first protrusion portion is disposed on a midpoint of a first axis from the first end portion to the second end portion; and the second protrusion portion is disposed on a midpoint of a second axis from the third end portion to the fourth end portion.

3. The rolling mechanism of claim 1, wherein:

the two main rolls and the two auxiliary rolls separately comprise at least three truncated cones arranged along a corresponding roll axis; each truncated cone comprises a top surface and a base surface; every two adjacent truncated cones are connected by attaching the top surface to an adjacent base surface; the top surface has the same diameter as the adjacent base surface; and at least two of the at least three truncated cones of each main roll are disposed between the first protrusion portion and the second end portion, and at least two of the at least three truncated cones of each auxiliary roll are disposed between the second protrusion portion and the fourth end portion.

4. The rolling mechanism of claim 3, wherein each truncated cone has a roll surface angle ranging from 2.5° to 5°.

5. The rolling mechanism of claim 3, wherein the at least three truncated cones of each main roll comprise a first truncated cone and a second truncated cone arranged from the first end portion to the second end portion; the first protrusion portion is formed between the first truncated cone and the second truncated cone; and the at least three truncated cones of each auxiliary roll comprise a third truncated cone and a fourth truncated cone arranged from the third end portion to the fourth end portion; the second protrusion portion is formed between the third truncated cone and the fourth truncated cone.

6. The rolling mechanism of claim 5, wherein a ratio of a length of each main roll to a diameter of the first protrusion portion ranges from 3 to 7; and/or a ratio of a diameter of the first protrusion portion to a diameter of the second protrusion portion ranges from 1 to 2.

7. A method for rolling an ultra-fine-grained M50NiL rod by using the rolling mechanism of claim 1, the method comprising:

S1. preparing an M50NiL rod with a diameter ranging from 220 mm to 350 mm as a billet;

S2. heating the billet within a preset time at a preset temperature;

S3. feeding the billet into the rolling mechanism to obtain a semi-finished product; and S4. cooling the semi-finished product to obtain the ultra-fine-grained M50NiL rod;

wherein an entry angle of the rolling mechanism ranges from 10° to 13°; and a nip angle of the rolling mechanism ranges from 7° to 10°.

8. The method of claim 7, wherein S3 further comprises: S3-1: feeding the heated billet through a feed inlet adjacent to the two second end portions into the nip zone for rolling, and forcing the semi-finished product to move through a feed outlet adjacent to the two fourth end portions.

9. The method of claim 8, wherein the two main rolls have the same shape as the two auxiliary rolls; the two main rolls and the two auxiliary rolls separately comprise at least three truncated cones arranged along a corresponding roll axis; at least two of the at least three truncated cones of each main roll are disposed between the first protrusion portion and the second end portion, and at least two of the at least three truncated cones of each auxiliary roll are disposed between the second protrusion portion and the fourth end portion; for each main roll, a first truncated cone and a second truncated cone among the at least three truncated cones of the main roll are arranged from the first end portion to the second end portion; the first protrusion portion is formed between the first truncated cone and the second truncated cone; for each auxiliary roll, a third truncated cone and a fourth truncated cone among the at least three truncated cones of the auxiliary roll are arranged from the third end portion to the fourth end portion; the second protrusion portion is formed between the third truncated cone and the fourth truncated cone; distances between the two main rolls and between the two auxiliary rolls are adjustable; and S3 further comprises:

S3-2. adjusting the distances between the two main rolls and between the two auxiliary rolls; either feeding the heated billet through the feed inlet adjacent to the two second end portions into the nip zone for rolling and forcing the semi-finished product to move through the feed outlet adjacent to the two fourth end portions, or feeding the heated billet through a feed inlet adjacent to the two fourth end portions into the nip zone for rolling and forcing the semi-finished product to move through a feed outlet adjacent to the two second end portions; and S3-3. repeating S3-2.

10. The method of claim 9, wherein the two main rolls and the two auxiliary rolls rotate at a speed ranging from 11 r/min to 13 r/min.

11. The method of claim 7, wherein a ratio of a diameter of the first protrusion portion to a diameter of the billet ranges from 1 to 5.

* * * * *